US010971100B2

(12) United States Patent
Zhang et al.

(10) Patent No.: US 10,971,100 B2
(45) Date of Patent: Apr. 6, 2021

(54) PIXEL DRIVING CIRCUIT, DISPLAY PANEL HAVING THE PIXEL DRIVING CIRCUIT AND DRIVING METHOD OF DISPLAY PANEL

(71) Applicants: Chongqing BOE Optoelectronics Technology Co., Ltd., Chongqing (CN); BOE Technology Group Co., Ltd., Beijing (CN)

(72) Inventors: Ying Zhang, Beijing (CN); Sijun Lei, Beijing (CN); Xu Lu, Beijing (CN); Xianyong Gao, Beijing (CN); Shoujun Xiao, Beijing (CN); Yifan Huangfu, Beijing (CN); Zhicai Xu, Beijing (CN); Bo Ran, Beijing (CN); Yongli Ge, Beijing (CN)

(73) Assignees: CHONGQING BOE OPTOELECTRONICS TECHNOLOGY CO., LTD., Chongqing (CN); BOE TECHNOLOGY GROUP CO., LTD., Beijing (CN)

( * ) Notice: Subject to any disclaimer, the term of this patent is extended or adjusted under 35 U.S.C. 154(b) by 10 days.

(21) Appl. No.: 16/536,834

(22) Filed: Aug. 9, 2019

(65) Prior Publication Data

US 2020/0098326 A1 Mar. 26, 2020

(30) Foreign Application Priority Data

Sep. 20, 2018 (CN) ..... 201811100345.9

(51) Int. Cl.

| | |
|---|---|
| ***G09G 3/36*** | (2006.01) |
| ***G09G 3/3266*** | (2016.01) |
| ***G09G 3/3275*** | (2016.01) |

(52) U.S. Cl.
CPC ..... *G09G 3/3674* (2013.01); *G09G 3/3266* (2013.01); *G09G 3/3275* (2013.01); (Continued)

(58) Field of Classification Search
CPC .. G09G 3/3674; G09G 3/3266; G09G 3/3275; G09G 3/3685; G09G 2310/0202; (Continued)

(56) References Cited

U.S. PATENT DOCUMENTS 6,329,973 B1 * 12/2001 Akimoto ..... G06F 3/147 345/98
10,049,617 B2 * 8/2018 Shin ..... G06F 3/011
(Continued)

*Primary Examiner* — Chad M Dicke
(74) *Attorney, Agent, or Firm* — Nath, Goldberg & Meyer; Joshua B. Goldberg

(57) ABSTRACT

The present disclosure provides a driving method of a display panel, the display panel including a plurality of pixels, each row of pixels correspond to a gate line, each column of pixels correspond to a data line, the driving method including: comparing a current frame of image with a previous frame of image to determine a non-changing row of the pixels, contents displayed by each pixel in the non-changing row for the current frame of image and contents displayed by each pixel in the non-changing row for the previous frame of image are the same; selecting a non-charging row from the non-changing row according to a predetermined time; providing, when displaying the current frame of image, an invalid signal to the gate line of the non-charging row during a scanning time for the gate line of the non-charging row to not to charge the non-charging row.

15 Claims, 4 Drawing Sheets

(52) U.S. Cl.
CPC ... *G09G 3/3685* (2013.01); *G09G 2310/0202* (2013.01); *G09G 2310/0251* (2013.01); *G09G 2310/08* (2013.01); *G09G 2330/023* (2013.01)

(58) Field of Classification Search
CPC ..... G09G 2310/0251; G09G 2310/08; G09G 2330/023; G09G 2330/021; G09G 2300/0842
See application file for complete search history.

(56) References Cited

U.S. PATENT DOCUMENTS 10,068,530 B2 * 9/2018 Lee ..... G09G 3/3233
10,170,049 B2 * 1/2019 Ryu ..... G09G 3/3275
10,262,567 B2 * 4/2019 Cok ..... G09G 3/2003
10,338,711 B2 * 7/2019 Kim ..... G06F 3/044
10,452,218 B2 * 10/2019 Yamamoto ..... G09G 3/2096
10,510,292 B2 * 12/2019 Jang ..... G09G 3/3233
2002/0036626 A1 * 3/2002 Tsutsui ..... G09G 3/3659 345/204
2005/0078073 A1 * 4/2005 Mikami ..... G09G 3/3685 345/92
2005/0268141 A1 * 12/2005 Alben ..... G06F 1/3296 713/500
2006/0012592 A1 * 1/2006 Sato ..... G09G 3/3208 345/204
2006/0238552 A1 * 10/2006 Chuang ..... G09G 5/006 345/690
2010/0020050 A1 * 1/2010 Arai ..... G09G 1/167 345/204
2010/0026627 A1 * 2/2010 Arai ..... G06F 3/14 345/163
2010/0177072 A1 * 7/2010 Kawabe ..... G09G 3/3266 345/205
2012/0056862 A1 * 3/2012 Yamazaki ..... G09G 3/3275 345/207
2012/0206461 A1 * 8/2012 Wyatt ..... G06F 1/3218 345/501
2013/0249779 A1 * 9/2013 Harada ..... G09G 3/3611 345/88
2014/0085276 A1 * 3/2014 Jang ..... G09G 3/20 345/204
2014/0118378 A1 * 5/2014 Koyama ..... G09G 5/00 345/546
2014/0132615 A1 * 5/2014 Lee ..... G09G 5/006 345/541
2014/0192101 A1 * 7/2014 Tsuge ..... G09G 3/3225 345/690
2014/0198093 A1 * 7/2014 Nambi ..... G09G 3/3696 345/212
2014/0375627 A1 * 12/2014 Kim ..... G09G 3/3677 345/214
2016/0358303 A1 * 12/2016 Juliano ..... G09G 5/395
2017/0154601 A1 * 6/2017 Gao ..... G09G 3/2074
2018/0047342 A1 * 2/2018 Wang ..... G09G 3/2044
2018/0286341 A1 * 10/2018 Nagasaka ..... H01L 27/1244
2019/0333477 A1 * 10/2019 Kambe ..... G09G 3/20

* cited by examiner

DRAWINGS

PIXEL DRIVING CIRCUIT, DISPLAY PANEL HAVING THE PIXEL DRIVING CIRCUIT AND DRIVING METHOD OF DISPLAY PANEL

CROSS-REFERENCE TO RELATED APPLICATIONS

The present application claims the priority of Chinese Patent Application No. 201811100345.9, filed on Sep. 20, 2018, the contents of which are incorporated herein in their entirety by reference.

TECHNICAL FIELD

The present disclosure relates to the field of display technology, and particularly to a driving method of a display panel, a pixel driving circuit, and a display panel.

BACKGROUND

A liquid crystal display device has the advantages of being thin and light, energy-saving, and radiation-free, and thus is widely used in high-definition digital televisions, desktop computers, personal digital assistants, notebook computers, mobile phones and the like.

SUMMARY

Embodiments of the present disclosure provide a driving method of a display panel, the display panel including a plurality of pixels arranged in an array, each row of pixels corresponds to a gate line, and each column of pixels corresponds to a data line, the driving method includes: comparing a current frame of image with a previous frame of image to determine a non-changing row in a pixel array, contents displayed by pixels in the non-changing row for the current frame of image and contents displayed by pixels in the non-changing row for the previous frame of image are the same; selecting a non-charging row from the non-changing row according to a predetermined time; providing, when displaying the current frame of image, an invalid signal to the gate line of the non-charging row during a scanning time for the gate line of the non-charging row to not charge the non-charging row; the step of selecting the non-charging row from the non-changing rows according to the predetermined time includes: determining whether a time period of the non-changing row from the time when the current frame of image begins to be displayed to a time when a previous charging for the non-changing row is finished reaches a predetermined time, and in response to a negative determination, determining the non-changing row as a non-charging row, and in response to an affirmative determination, determining the non-changing row not as a non-charging row.

In some embodiments, the predetermined time is a difference between a maximum time that a pixel can keep displaying normally after being charged once and a time for displaying a frame of image.

In some embodiments, when the current frame of image is displayed, no signal is provided to each data line during a scanning time for the gate line of the non-charging row.

In some embodiments, the display panel further includes: a gate line driving circuit for driving each gate line, a data line driving circuit for driving each data line, a timing controller for providing control signals to the gate line driving circuit and the data line driving circuit; the step of providing, when displaying the current frame of image, an invalid signal to the gate line of the non-charging row during the scanning time for the gate line of the non-charging row to not charge the non-charging row further includes: providing, when displaying the current frame of image, an invalid control signal to the gate line driving circuit and the data line driving circuit through the timing controller during the scanning time for the gate line of the non-charging row, to control the gate line driving circuit to provide an invalid signal to the gate line of the non-charging row and to control the data line driving circuit not to provide a signal to each data line.

In some embodiments, the timing controller is configured to generate a control signal based on an input signal at an input terminal thereof, and when an invalid input signal is received by the input terminal of the timing controller, an invalid control signal is output by the timing controller, and when a valid input signal is received by the input terminal of the timing controller, a valid control signal is output by the timing controller; the display panel further includes a first control circuit, a second control circuit and an AND gate circuit, a first input terminal of the AND gate circuit is coupled to the first control circuit, and a second input terminal of the AND gate circuit is coupled to the second control circuit, and an output terminal of the AND gate circuit is coupled to an input terminal of the timing controller, the first control circuit is configured to output an original signal, and the second control circuit is configured to generate an additional control signal based on the non-charging row for the current frame of image; the step of determining whether a time period of the non-changing row from a time when the current frame of image begins to be displayed to a time when a previous charging for the non-changing row is finished reaches a predetermined time, and in response to a negative determination, determining the non-changing row as a non-charging row, and in response to an affirmative determination, determining the non-changing row not as a non-charging row further includes: controlling, when displaying the current frame of image, the additional control signal to be invalid during the scanning time for the gate line of the non-charging row, and the additional control signal to be valid during the scanning time for the gate line of any row other than non-charging row in the pixel array.

In some embodiments, the step of comparing the current frame of image with a previous frame of image to determine the non-changing row in the pixel array includes: determining the non-changing row according to an interframe difference method.

In some embodiments, the step of determining the non-changing row according to the interframe difference method includes: extracting a pixel by which contents displayed for the current frame of image being different from contents displayed for the previous frame of image, and locating a row having the pixel in the pixel array, and determining other rows in the pixel array as non-changing rows.

In some embodiments, after the step of selecting a non-charging row from the non-changing row according to a predetermined time, the driving method further includes: recording, a sum of a time period of the non-changing row from the time when the current frame of image begins to be displayed to a time when a previous charging for the non-charging row is finished and a displaying time of a frame of image.

Embodiments of the present disclosure provide a pixel driving circuit, including a timing controller, a gate line driving circuit, and a data line driving circuit, output terminals of the timing controller are coupled to the gate line driving circuit and the data line driving circuit respectively to provide control signals to the gate line driving circuit and the data line driving circuit respectively, and the pixel driving circuit further includes: an AND gate circuit having an output terminal coupled to an input terminal of the timing controller; a first control circuit having an output terminal coupled to a first input terminal of the AND gate circuit and configured to output an original signal; a second control circuit having an output terminal coupled to a second input terminal of the AND gate circuit and configured to select a non-charging row from non-changing rows according to a predetermined time, the non-changing row is a row that all the pixels therein display a same content in a current frame of image and a previous frame of image, the non-charging row is a row within the non-changing rows of which a time period from a time when the current frame of image begins to be displayed to a time when the previous charging for the row is finished reaches a predetermined time; the gate line driving circuit is configured to provide, when displaying the current frame of image, an invalid signal to a gate line of any one of the non-charging row during a scanning time of the gate line of the non-charging row to not to charge the non-charging row.

In some embodiments, the second control circuit is further configured to: compare the current frame of image with the previous frame of image to determine the non-changing row in a pixel array; determine whether a time period of each of the non-changing rows from the time when the current frame of image begins to be displayed to a time when a previous charging for the non-changing row is finished reaches a predetermined time, and in response to a negative determination, determine the non-changing row as a non-charging row, and in response to an affirmative determination, determine the non-changing row not as a non-charging row.

In some embodiments, the predetermined time is a difference between a maximum time that a pixel can keep displaying normally after being charged once and a time for displaying a frame of image.

In some embodiments, the data line driving circuit is configured not to provide, when displaying the current frame of image, a signal to each data line during the scanning time for the gate line of the non-charging row.

In some embodiments, the second control circuit is configured to: generate an additional control signal based on the non-charging rows for the current frame of image; and control, when displaying the current frame of image, the additional control signal to be invalid during the scanning time for the gate line of the non-charging row, and the additional control signal to be valid during the scanning time for the gate line of any row other than non-charging row in the pixel array.

In some embodiments, the timing controller being configured to: generate a control signal based on an input signal at an input terminal thereof, and when an invalid input signal is received by the input terminal of the timing controller, an invalid control signal is output by the timing controller, and when a valid input signal is received by the input terminal of the timing controller, a valid control signal is output by the timing controller; provide, when displaying the current frame of image, an invalid control signal to the gate line driving circuit and the data line driving circuit respectively during the scanning time for the gate line of the non-charging row, to control the gate line driving circuit to provide an invalid signal to the gate line of the non-charging row and to control the data line driving circuit not to provide a signal to each data line.

In some embodiments, the gate line driving circuit is a gate driving chip; and the data line driving circuit is a data driven chip.

Embodiments of the present disclosure provide a display panel including the pixel driving circuit above.

In some embodiments, the display panel is a liquid crystal display panel or an organic light emitting diode display panel.

DETAILED DESCRIPTION

Figure 1:
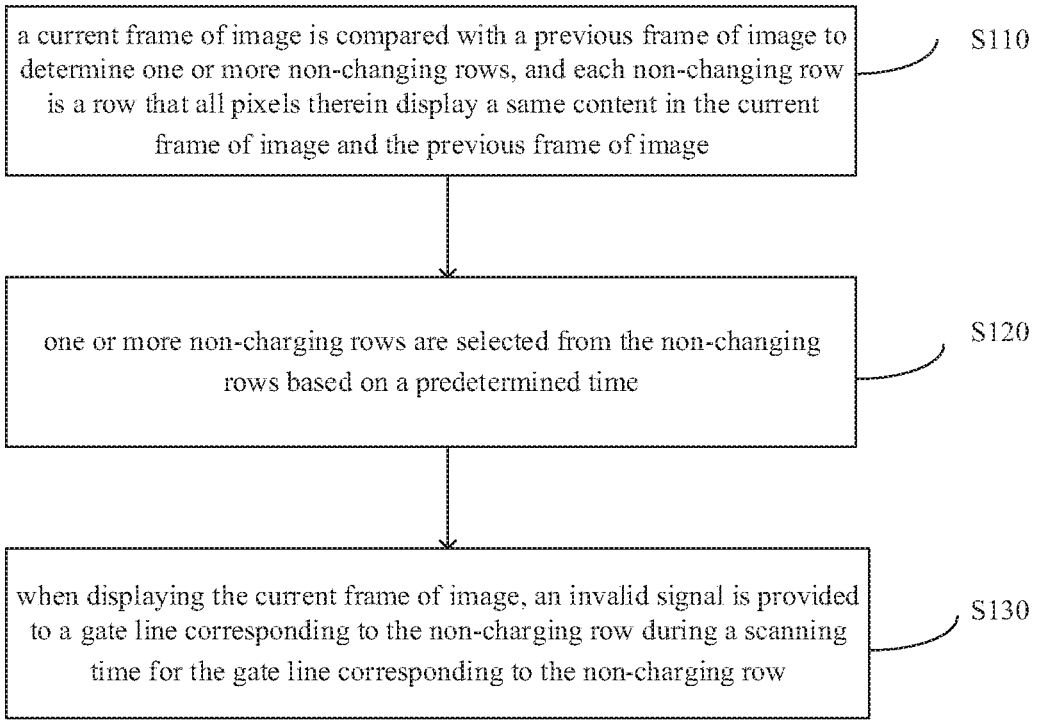
FIG. 1 is a schematic flow chart of a driving method of a display panel according to an embodiment of the present disclosure.

In a liquid crystal display panel of the related art, generally, pixels are scanned and turned on row by row so that the pixels are charged. The time for charging each row of pixels is constant. For example, when a display screen has a resolution of 1920×1080, a frame of image has 1080 rows of pixels, and under a refresh rate of 60 Hz, the time for turning on each row of pixels is approximately equal to 15.4 μs. However, if the liquid crystal display panel shows a same picture for a long time, that is, contents displayed by the pixels does not change in continuous frames, each row of pixels is still turned on periodically and charged, which causes an increasing power consumption and waste of resources.

The present disclosure will be further described in detail below in conjunction with the drawings and specific embodiments. Throughout the drawings, the same or similar reference numerals are used to refer to the same or similar elements. For the sake of clarity, the various parts in the figures are not drawn to scale. Moreover, some well-known parts may not be shown in the figures.

Many specific details of the disclosure are described below, such as the stricture, materials, size, processing and techniques of the components in order to provide a clear understanding of the present disclosure. However, as will be understood by those skilled in the art, the present disclosure may be implemented without these specific details.

According to a first aspect of the present disclosure, as shown in FIG. 1, the embodiment provides a driving method of a display panel. The display panel includes a plurality of pixels arranged in an array, and each row of pixels correspond to a gate line, and each column of pixels correspond to a data line, the method includes the following steps S110 to S130

At step S110, a current frame of image is compared with a previous frame of image to determine one or more non-changing rows, and each non-changing row is a row that all pixels therein display a same content in the current frame of image and the previous frame of image.

Rows, except for the non-changing rows, in the pixel array are belonging to changing rows, and at least one of pixels in a changing row displays different contents in a current frame of image and a previous frame of image respectively.

At step S120, one or more non-charging rows are selected from the non-changing rows based on a predetermined time.

Specifically, it is determined that whether a time period of a non-changing row from a time when a current frame of image begins to be displayed to a time when a previous charging for the non-changing row is finished reaches a predetermined time, if "YES", the non-changing row is determined as a non-charging row, and if "NO", the non-changing row is not determined as a non-charging row.

The non-charging row is not charged in a current frame of image, that is, the pixels in the non-charging row can display normally without being charged for a certain time period. Specifically, if a time period of a non-changing row from a time when a current frame of image begins to be displayed to a time when a previous charging for the non-changing row is finished does not exceed the predetermined time, it indicates that the pixels in the non-changing row can keep displaying normally until a next frame of image, without being charged at the time when the current frame of image begins to be displayed, thus the non-changing row can be determined as a non-charging row. However, if the time period of a non-changing row from a time when a current frame of image begins to be displayed to a time when a previous charging for the non-changing row is finished reaches or exceeds the predetermined time, it indicates that pixels in the non-changing row may not display normally for the current frame of image if the pixels in the non-changing row are still not charged for the current frame of image. Therefore, if a row of pixels that belong to a non-changing row needs to be charged, it is a non-changing row only but not determined as a non-charging row.

In other words, if a time period that a non-changing row is continuously regarded as a non-charging row is within a certain time period, that is, pixels in the non-changing row may display normally for a current frame of image, the non-changing row is determined as a non-charging row. If a time period that a non-changing row is continuously regarded as a non-charging row reaches or exceeds a certain time period, that is, the pixels in the non-changing row may not display normally for the current frame of image, the non-changing row needs to be driven.

At step S130, when displaying the current frame of image, an invalid signal is provided to a gate line corresponding to the non-charging row during a scanning time for the gate line corresponding to the non-charging row.

That is to say, the non-changing rows in which pixels can display normally are not charged.

In the driving method of a display panel according to the embodiment, comparing the current frame of image with the previous frame of image, a row in which all pixels display a same content in the current frame of image and the previous frame of image is determined as a non-changing row. Since the content displayed in the non-changing row is unchanged, ideally, even if the non-changing row is not charged, by using storage capacitors, the non-changing row may maintain the previous displaying properly. However, in reality, if the time during which the non-changing row is continuously uncharged exceeds a certain time period, it may not display properly due to current leakage of the capacitor and liquid crystal polarization, or the like. Therefore, in this embodiment, non-charging rows are selected from the non-changing rows according to the time of the non-changing rows being continuously uncharged, and only the non-charging rows are not charged. Therefore, in this embodiment, a part of the non-changing rows, i.e., the non-charging rows, are not driven, that is, the non-charging rows are not charged. In such a way, the power consumption of the gate line driving circuit may be reduced while ensuring a normal display of images, and leakage and polarization caused by long-term non-charging may be avoided.

Figure 2:
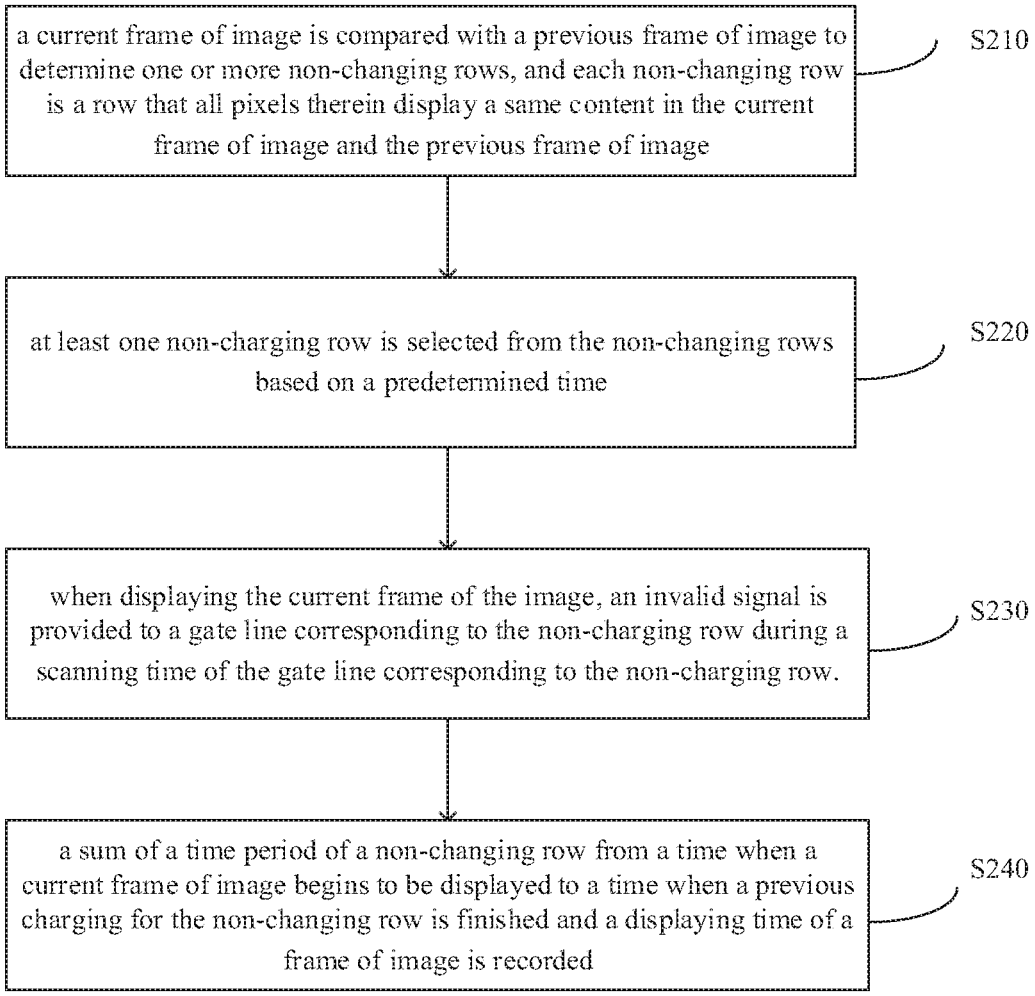
FIG. 2 is a schematic flow chart of another driving method of a display panel according to an embodiment of the present disclosure.

According to a second aspect of the present disclosure, as shown in FIG. 2, the embodiment provides a driving method of a display panel. The display panel includes a plurality of pixels arranged in an array, and each row of pixels correspond to a gate line, and each column of pixels correspond to a data line, the method includes the following steps S210 to S240.

At step S210, a current frame of image is compared with a previous frame of image to determine one or more non-changing rows, and each non-changing row is a row that all pixels therein display a same content in the current frame of image and the previous frame of image.

Rows, except for the non-changing rows, in the pixel array are belonging to changing rows, and at least one of pixels in a changing row displays different contents in a current frame of image and a previous frame of image respectively.

Specifically, according to an interframe difference method, a current frame of image is compared with a previous frame of image to determine a non-changing row.

Figure 3:
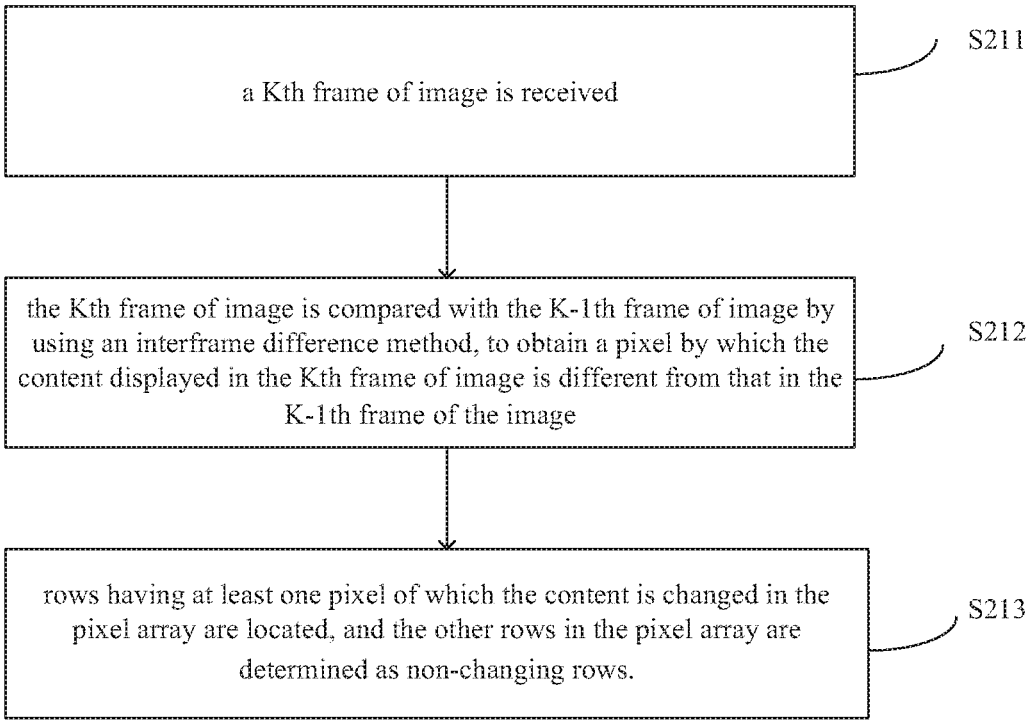
FIG. 3 is a flow chart of an interframe difference method adopted in a driving method of a display panel according to an embodiment of the present disclosure.

As shown in FIG. 3, the interframe difference method includes the following steps S211 to S213.

At step S211, a Kth frame of image is received;

At step S212, the Kth frame of image is compared with the K−1th frame of image by using an interframe difference method, to obtain a pixel by which the content displayed in the Kth frame of image is different from that in the K−1th frame of the image, that is, the content displayed by the pixel has changed;

At step S213, rows having at least one pixel of which the content is changed in the pixel array are located, and the other rows in the pixel array are determined as non-changing rows.

The interframe difference method not only has simple algorithm implementation, but also simple program design, which can improve the performance of the display panel.

At step 220, at least one non-charging row is selected from the non-changing rows based on a predetermined time.

Specifically, at least one non-charging row being selected from the non-changing rows based on a predetermined time comprises: it is determined that whether a time period of a non-changing row from the of the time when a current frame of image begins to be displayed to a time when a previous charging for the non-changing row is finished reaches a predetermined time, if "YES", the non-changing row is determined as a non-charging row, and if "NO", the non-changing row is not determined as a non-charging row.

The non-charging row is a row that is not charged at the time when the current frame of image begins to be displayed, and pixels in the non-charging row can display normally without being charged for a certain time period. Therefore, if a time period of a non-changing row from a time when a current frame of image begins to be displayed to a time when a previous charging for the non-changing row is finished does not exceed the predetermined time, it indicates that the pixels in the non-changing row can keep displaying normally until a next frame of image, without being charged at the time when the current frame of image begins to be displayed, thus the non-changing row can be determined as a non-charging row. However, if the time period of a non-changing row front the time when a current frame of image begins to be displayed to a time when a previous charging for the non-changing row is finished reaches or exceeds the predetermined time, it indicates that pixels in the non-changing row may not display normally for the current frame of image if the pixels in the non-changing row are still not charged at the time when the current frame of image begins to be displayed. Therefore, if a row of pixels that belongs to a non-changing row needs to be charged, it is a non-changing row only but not determined as a non-charging row.

In other words, if a time period that a non-changing row is continuously regarded as a non-charging row is within a certain time period, that is, pixels in the non-changing row may display normally. If a time period that a non-changing row is continuously regarded as a non-charging row reaches or exceeds a certain time period, that is, the pixels in the non-changing row may not display normally, the non-changing row is determined to be driven.

In some embodiments, the predetermined time may less than or equal to a difference which can be obtained by a maximum time that a pixel can keep displaying normally after being charged once minus a time for displaying a frame of image.

For example, a minimum screen refresh rate of the display panel is 30 Hz, which indicates that based on the design of the display panel, the maximum time that a pixel can keep displaying normally after being charged once may be 1/30 s, and if the displaying time exceeds 1/30 s (i.e., the maximum time), the displaying of the pixel will be unproperly due to leakage, polarization, etc. Correspondingly, if the display is currently performed at a refresh rate of 120 Hz, the predetermined time may equal to 1/30 s-1/120 s.

Certainly, as for the calculation of the threshold time, it is related to the starting point of the calculation of the predetermined time. If the starting point of the calculation of the predetermined time is different, the value of the predetermined time is also different. For example, if a time when the display of the current frame of image starts is used as a starting point to calculate the predetermined time, the threshold time is 1/30 s-1/120 s; and if a time when the display of the current frame of image ends is used as a starting point to calculate the predetermined time, the threshold time is 1/30 s. However, it should be understood that these different predetermined times are substantially equivalent.

The predetermined time can be obtained by the maximum time that a pixel can keep displaying normally after being charged once minus a time for displaying a frame of image. The non-charging row may be guaranteed to have a longest un-charging time, thereby the power consumption of gate line driving circuit may be reduced and the performance of the display panel may be improved, while the display panel may display normally.

For example, when a minimum screen refresh rate of a display panel is 30 Hz, and assuming that an actual screen refresh rate is 90 Hz, the predetermined time may equal to 1130 s-1/90 s. If the display contents of a first row of pixels for a second frame of image and a third frame of image are the same as the display content of a first row of pixels for a first frame of image, the first row of pixels is a non-changing row. Since the first row of pixels is charged when the first frame of image is started to be displayed, and a time difference between a time when the third frame of image is started to be displayed and a time when the first frame of image is started to be displayed (that is, a time when the previous charge of the first row of pixels is finished) is 2/90 s, which is within a range from 1/30 s to 1/90 s and has reached the above predetermined time when starting to display the third frame of image. That is to say, the first row of pixels needs to be charged when the third frame of image is displayed, and the first row of pixels does not need to be charged when the second frame of image is displayed as the first row of pixels is determined as a non-charging row. However, when the third frame is displayed, the first row of pixels is still determined as a non-changing row, but cannot be determined as a non-charging row, which means that the first row of pixels needs to be charged for the third frame of image.

At step S230, when displaying the current frame of the image, an invalid signal is provided to a gate line corresponding to the non-charging row during a scanning time of the gate line corresponding to the non-charging row.

That is, no charging is required for the non-changing row in which pixels may be normally displayed. For example, if the invalid signal has a low level and the valid signal has a high level, when the current frame of image is displayed, the non-charging row may always receive a low level signal, and the other rows in the pixel array receive a high level signal during their respective scanning times, and receive a low level signal during other times.

In some embodiments, when the current frame of image is displayed, no signal is provided to each data line during the scanning time of the gate line corresponding to the non-charging row.

That is, when the signal received by the gate line corresponding to the non-charging row is invalid when the non-charging row is scanned, and the signal received by data lines is also invalid.

By this way, both power consumptions of the gate line driving circuit and the data line driving circuit are reduced, thereby the power consumption of the display panel is further reduced.

In some embodiments, the display panel further includes: a gate line driving circuit for driving each gate line, a data line driving circuit for driving each data line, a timing controller (TCON) for providing control signals to the gate line driving circuit and the data line driving circuit. When the current frame of image is displayed, during the scanning time of a gate line corresponding to a non-charging row, an invalid control signal is provided to the gate line driving circuit and the data line driving circuit, respectively, by the timing controller, so that the gate line driving circuit provides an invalid signal to each gate line, and no signal is provided to the data lines by the data line driving circuit.

In detail, the timing controller is used to generate control signals (for example, a plurality of CLK signals, based on the scanning time of each row of pixels, different levels may represent the validness of the CLK signal in different scanning time) to control the gate line driving circuit and the data line driving circuit. In this embodiment, by changing the control signals generated by the timing controller, it is possible to control signals output to the gate lines or the data lines by the gate line driving circuit and the data line driving circuit.

An automatic control of the timing controller can improve efficiency of operation of the display panel while ensuring accurate signal transmission.

In some embodiments, the timing controller generates a control signal based on an original signal output by an original control circuit (i.e., the signal input to the timing controller without an additional control signal). When an invalid original signal is input to the timing controller, an invalid control signal is output by the timing controller. When a valid original signal is input to the timing controller, a valid control signal is output by the timing controller. The display panel further includes an additional control circuit and an AND gate circuit, and the additional control circuit is used to generate an additional control signal according to the non-charging row. The additional control signal is invalid at scanning time for non-charging rows, and is valid at scanning time for other rows in the pixel array. An input terminal of the AND gate circuit is coupled to the original control circuit, the other input terminal of the AND gate circuit is coupled to the additional control circuit, and an output terminal of the AND gate circuit is coupled to an input terminal of the timing controller. In addition, in some embodiments, the additional control circuit may be used to determine whether a row of pixels is a non-changing row, and determine whether a time period of each row of the non-changing rows from a time when a current frame of image is began to be displayed to a time when a previous charging for the non-changing row is finished reaches a predetermined time. If "NO", the row is determined as a non-charging row, and if "YES", the row is not determined as a non-charging row.

Figure 4A:
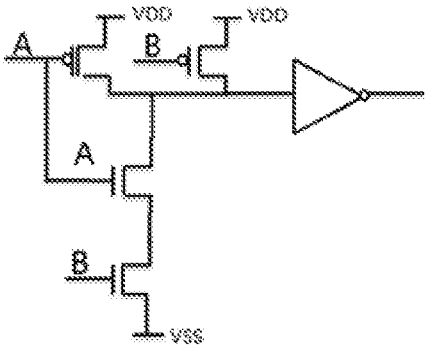
FIG. 4*a* is a schematic diagram illustrating an AND gate circuit of a display panel according to an embodiment of the present disclosure.

That is, an AND operation on the original signal and the additional control signal generated by the additional control circuit is performed by the AND gate circuit, and the output signal of the AND gate circuit is transmitted to the input terminal of the timing controller. As shown in FIG. 4*a*, "A" indicates the original signal and "B" indicates the additional control signal, if "A" is valid and "B" is invalid, an invalid signal is output; if "A" is invalid and "B" is invalid, an invalid signal is output; if "A" is invalid, and "B" is valid, and an invalid signal is output. Only if "A" and "B" both are valid, a valid signal is output.

Figure 4B:
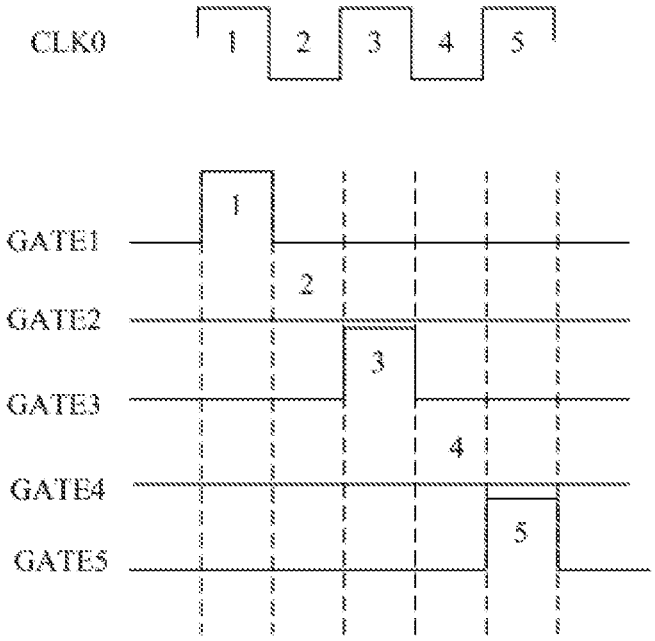
FIG. 4*b* is a driving timing diagram of a driving method of a display panel according to an embodiment of the present disclosure.

As shown in FIG. 4*b*, CLK0 is an additional control signal of the additional control circuit corresponding to the scanning time of the first row of pixels to the fifth row of pixels in the pixel array, and "GATE1" to "GATE5" are timing diagrams for the first row of pixels to the fifth row of pixels in the pixel array, and the timing diagrams "GATE1" to "GATE5" are generated by the gate line driving circuit based on the above additional control signal. It is assumed that the second row of pixels and the fourth row of pixels are determined as non-charging rows after the calculation, so the corresponding additional control signal is invalid (shown as a low level in FIG. 4*b*) in the respective scanning time corresponding to the second and fourth rows of pixels. After an AND operation by inputting both the additional control signal and the original signal to the AND gate circuit, the AND gate circuit inputs the corresponding signal to the timing controller, then the timing controller output a control signal which is changed (or different) compared to a control signal generated when only the original signal is input to the timing controller, and the gate line driving circuit provides signals, such as GATE1 to GATE5 (as shown in FIG. 4*b*), to each gate line based on the control signal generated by the AND operation. As shown in FIG. 4*b*, as for the second and fourth rows of pixels of which the control signal is unchanged (i.e., only the original signal are input to the timing controller), a high level signal may be received by gates of the second and fourth rows in their respective scanning time, however, as for the first, third and fifth rows of pixels of which the control signal is changed (i.e., the signal generated by the AND operation on the original signal and the additional control signal is input to the timing controller), a low level signal may be received by gates of the first, third and fifth rows of pixels in their respective scanning time.

The timing controller may be a chip, and the above additional control signal may also be calculated by the chip, that is, the additional control circuit may be integrated in the chip. Also, the AND gate circuit may also be integrated in the chip.

In some embodiments, the gate line driving circuit may be a gate driving chip. The data line driving circuit may be a data driven chip.

At step S240, a sum of a time period of a non-changing row from a time when a current frame of image begins to be displayed to a time when a previous charging for the non-changing row is finished and a displaying time of a frame of image is recorded.

That is to say, after a row of pixels is determined as a non-charging row, the sum above obtained when displaying the current frame of image, is the time period of the non-changing row from a time when a next frame of image begins to be displayed to a time when a previous charging for the non-changing row is finished. The value of the sum above may be used to determine whether the row of pixels belong to a non-changing row or not when displaying the next frame of image. In this way, the non-charging row can be accurately and quickly determined in the subsequent frame of image to ensure the normal operation of the display panel.

In the method of for driving the display panel according to the present embodiment, the current frame of image is compared with the previous frame of image, a row in which all pixels display a same content in the current frame of image and the previous frame of image is determined as a non-changing row. Since the content displayed in the non-changing row is unchanged, even if the non-changing row is not charged, the non-changing row may maintain the previous displaying properly by means of the capacitors. Therefore, in this embodiment, parts of the non-changing rows are not driven, that is, they are not charged, so the power consumption of the gate line driving circuit can be reduced.

However, if the time during which the non-changing row is continuously uncharged exceeds a certain time period, it may not display properly due to current leakage of the capacitors, liquid crystal polarization, or the like. Therefore, in this embodiment, non-charging rows are selected from the non-changing rows according to the time period during which the non-changing rows is continuously uncharged, and only the non-charging rows are not charged to avoid current leakage and liquid crystal polarization caused by a long-term non-charging.

Figure 5:
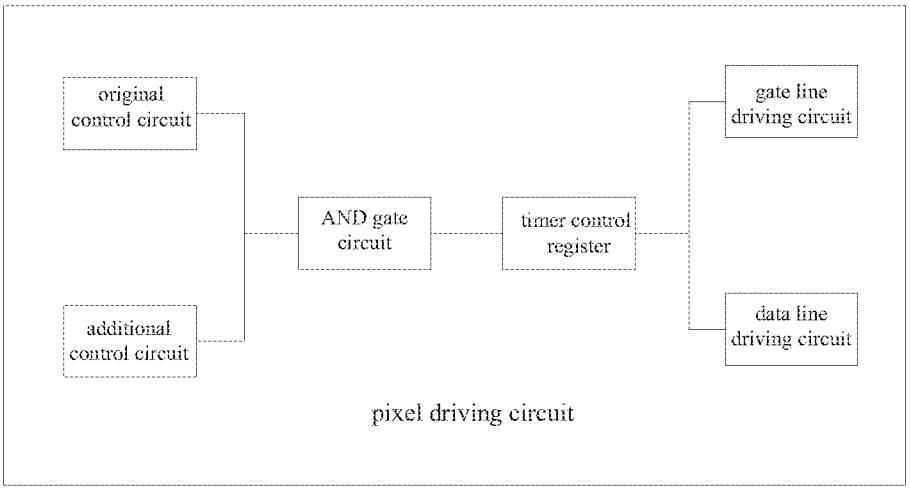
FIG. 5 is a schematic block diagram illustrating a configuration of a display panel according to an embodiment of the present disclosure.

According to the third aspect of the present disclosure, as shown in FIG. 5, it is provided a display panel including a plurality of pixels arranged in an array, and each row of pixels correspond to a gate line, and each column of pixels correspond to a data line.

The display panel further includes a pixel driving circuit for driving the display panel in accordance with the method of the first aspect or the second aspect of the present disclosure.

The pixel driving circuit includes a gate line driving circuit for driving gate lines, a data line driving circuit for driving data lines, and a timing controller for providing control signals to the gate line driving circuit and the data line driving circuit. The output terminals of the timing controller are respectively coupled to the input terminals of the gate line driving circuit and the data line driving circuit. When the current frame of image is displayed, the timing controller outputs invalid control signals to the gate line driving circuit and the data line driving circuit respectively, so that the gate line driving circuit provides an invalid signal to each gate line, and the data line driving circuit provides an invalid signal to each data line.

The pixel driving circuit further includes an additional control circuit and an AND gate circuit. An original control circuit is coupled to an input terminal of the AND gate circuit, the additional control circuit is coupled to another input terminal of the AND gate circuit, and an input terminal of the timing controller is coupled to an output terminal of the AND gate circuit.

The display device can be any product or component having a display function, such as a liquid crystal display panel, an organic light emitting diode display panel, an electronic paper, a mobile phone, a tablet computer, a television, a display, a notebook computer, a digital photo frame, a navigator, and the like.

It should be noted that, in the present disclosure, relational terms such as first and second, etc. are used merely to distinguish one entity or operation from another entity or operation, and do not necessarily require or imply these entities or operations have the actual relationship or order between them. Furthermore, the term "include" or "comprise" or any other variations thereof is intended to encompass a non-exclusive inclusion, such that a process, method, article, or device including a plurality of elements includes not only those elements but also other elements not explicitly listed, or further includes elements that are inherent to such a process, method, item, or device. An element defined by the phrase "includes a . . . " without further limitation does not exclude the presence of additional identical elements in the process, method, article, or device that includes the element.

The embodiments according to the present disclosure are described above and are not exhaustive of all the details, and are not intended to limit the present disclosure to the details of the embodiments described. Obviously, many modifications and variations are possible based on the above description. The embodiments selected and described in detail are intended to explain the principles and practical application of the present disclosure. Thus, those skilled in the art can make good use and modification of the present disclosure. The disclosure is to be limited only by the attached claims and the full scope thereof and equivalents.

What is claimed is:

1. A driving method of a display panel, the display panel comprising a plurality of pixels arranged in an array, wherein each row of pixels corresponds to a gate line, and each column of pixels corresponds to a data line, the method comprising:

comparing a current frame of image with a previous frame of image to determine a non-changing row in a pixel array, wherein contents displayed by pixels in the non-changing row for the current frame of image and contents displayed by pixels in the non-changing row for the previous frame of image are the same;

selecting a non-charging row from the non-changing row according to a predetermined time;

providing, when displaying the current frame of image, an invalid signal to the gate line of the non-charging row during a scanning time for the gate line of the non-charging row to not charge the non-charging row, wherein selecting the non-charging row from the non-changing row according to the predetermined time comprises:

determining whether a time period of the non-changing row from a time when the current frame of image begins to be displayed to a time when a previous charging for the non-changing row is finished reaches a predetermined time, and in response to a negative determination, determining the non-changing row as a non-charging row, and in response to an affirmative determination, determining the non-changing row not as a non-charging row;

wherein the display panel further comprises: a gate line driving circuit for driving each gate line, a data line driving circuit for driving each data line, a timing controller for providing control signals to the gate line driving circuit and the data line driving circuit, wherein, providing, when displaying the current frame of image, an invalid signal to the gate line of the non-charging row during the scanning time for the gate line of the non-charging row to not charge the non-charging row further comprises:

providing, when displaying the current frame of image, an invalid control signal to the gate line driving circuit and the data line driving circuit through the timing controller during the scanning time for the gate line of the non-charging row, to control the gate line driving circuit to provide an invalid signal to the gate line of the non-charging row and to control the data line driving circuit not to provide a signal to each data line, wherein the timing controller is configured to generate a control signal based on an input signal at an input terminal thereof, and when an invalid input signal is received by the input terminal of the timing controller, an invalid control signal is output by the timing controller, and when a valid input signal is received by the input terminal of the timing controller, a valid control signal is output by the timing controller, the display panel further comprises a first control circuit, a second control circuit and an AND gate circuit, a first input terminal of the AND gate circuit is coupled to an output terminal of the first control circuit, and a second input terminal of the AND gate circuit is coupled to an output terminal of the second control circuit, and an output terminal of the AND gate circuit is coupled to the input terminal of the timing controller, wherein the first control circuit is configured to output an original signal to the first terminal of the AND gate circuit, and the second control circuit is configured to generate an additional control signal based on the non-charging row for the current frame of image and output the additional control signal to the second input terminal of the AND gate circuit, and the AND gate circuit is configured to output a signal generated by the AND operation on the original signal and the additional control signal to the timing controller, wherein, determining whether a time period of the non-changing row from a time when the current frame of image begins to be displayed to a time when a previous charging for the non-changing row is finished reaches a predetermined time, and in response to a negative determination, determining the non-changing row as a non-charging row, and in response to an affirmative determination, determining the non-changing row not as a non-charging row further comprises:

controlling, when displaying the current frame of image, the additional control signal to be invalid during the scanning time for the gate line of the non-charging row, and the additional control signal to be valid during the scanning time for the gate line of any row other than non-charging row in the pixel array.

2. The driving method of claim 1, wherein the predetermined time is a difference between a maximum time that a pixel can keep displaying normally after being charged once and a time for displaying a frame of image.

3. The driving method of claim 1, wherein, when the current frame of image is displayed, no signal is provided to each data line during a scanning time for the gate line of the non-charging row.

4. The driving method of claim 1, wherein comparing the current frame of image with a previous frame of image to determine the non-changing row in the pixel array comprises: determining the non-changing row according to an interframe difference method.

5. The driving method of claim 4, wherein determining the non-changing row according to the interframe difference method comprises:

extracting a pixel by which contents displayed for the current frame of image being different from contents displayed for the previous frame of image, and locating a row having the pixel in the pixel array, and determining other rows in the pixel array as non-changing rows.

6. The driving method of claim 1, wherein after selecting a non-charging row from the non-changing row according to a predetermined time, the driving method further comprises:

recording, a sum of a time period of the non-charging row from the current frame of image begins to be displayed to a time when a previous charging for the non-charging row is finished and a displaying time of a frame of image.

7. A pixel driving circuit, comprising a timing controller, a gate line driving circuit, and a data line driving circuit, wherein output terminals of the timing controller are coupled to the gate line driving circuit and the data line driving circuit respectively to provide control signals to the gate line driving circuit and the data line driving circuit respectively, and the pixel driving circuit further comprises:

an AND gate circuit having an output terminal coupled to an input terminal of the timing controller;

a first control circuit having an output terminal coupled to a first input terminal of the AND gate circuit and configured to output an original signal to the first input terminal of the AND gate circuit;

a second control circuit having an output terminal coupled to a second input terminal of the AND gate circuit and configured to select a non-charging row from non-changing rows according to a predetermined time to generate an additional control signal and output the additional control signal to the second input terminal of the, wherein the non-changing row is a row that all the pixels therein display a same content in a current frame of image and a previous frame of image, the non-charging row is a row within the non-changing rows of which a time period from a time when the current frame of image begins to be displayed to a time when the previous charging for the row is finished reaches a predetermined time, wherein the AND gate circuit is further configured to output a signal generated by an AND operation on the original signal and the additional control signal to the timing controller, and wherein the gate line driving circuit is configured to provide, when displaying the current frame of image, an invalid signal to a gate line of the non-charging row during a scanning time of the gate line of the non-charging row to not to charge the non-charging row.

8. The pixel driving circuit of claim 7, wherein the second control circuit is further configured to:

compare the current frame of image with the previous frame of image to determine the non-changing row in a pixel array;

determine whether a time period of each of the non-changing rows from a time when the current frame of image begins to be displayed to a time when a previous charging for the non-changing row is finished reaches a predetermined time, and in response to a negative determination, determine the non-changing row as a non-charging row, and in response to an affirmative determination, determine the non-changing row not as a non-charging row.

9. The pixel driving circuit of claim 7, wherein the predetermined time is a difference between a maximum time that a pixel can keep displaying normally after being charged once and a time for displaying a frame of image.

10. The pixel driving circuit of claim 7, wherein the data line driving circuit is configured not to provide, when displaying the current frame of image, a signal to each data line during the scanning time for the gate line of the non-charging row.

11. The pixel driving circuit of claim 7, the second control circuit is configured to:

generate an additional control signal based on the non-charging row for the current frame of image; and control, when displaying the current frame of image, the additional control signal to be invalid during the scanning time for the gate line of the non-charging row, and the additional control signal to be valid during the scanning time for the gate line of any row other than non-charging row in the pixel array.

12. The pixel driving circuit of claim 7, the timing controller being configured to:

generate a control signal based on an input signal at an input terminal thereof, and when an invalid input signal is received by the input terminal of the timing controller, an invalid control signal is output by the timing controller, and when a valid input signal is received by the input terminal of the timing controller, a valid control signal is output by the timing controller; and provide, when displaying the current frame of image, an invalid control signal to the gate line driving circuit and the data line driving circuit respectively during the scanning time for the gate line of the non-charging row, to control the gate line driving circuit to provide an invalid signal to the gate line of the non-charging row and to control the data line driving circuit not to provide a signal to each data line.

13. The pixel driving circuit of claim 7, wherein the gate line driving circuit is a gate driving chip; and the data line driving circuit is a data driven chip.

14. A display panel comprising the pixel driving circuit of claim 7.

15. The display panel of claim 14, wherein the display panel is a liquid crystal display panel or an organic light emitting diode display panel.

* * * * *